US010119435B2

(12) United States Patent
Hoglund et al.

(10) Patent No.: US 10,119,435 B2
(45) Date of Patent: Nov. 6, 2018

(54) COMBUSTION ENGINE AND MANTLE ASSEMBLY THEREFORE

(71) Applicant: FREEVALVE AB, Angelholm (SE)

(72) Inventors: Anders Hoglund, Munka Ljungby (SE); Urban Carlson, Helsingborg (SE); Christian Von Koenigsegg, Vejbystrand (SE)

(73) Assignee: Freevalve AB, Angelholm (SE)

( * ) Notice: Subject to any disclaimer, the term of this patent is extended or adjusted under 35 U.S.C. 154(b) by 145 days.

(21) Appl. No.: 15/025,396

(22) PCT Filed: Oct. 8, 2014

(86) PCT No.: PCT/SE2014/051187
§ 371 (c)(1),
(2) Date: Mar. 28, 2016

(87) PCT Pub. No.: WO2015/057133
PCT Pub. Date: Apr. 23, 2015

(65) Prior Publication Data

US 2016/0237864 A1 Aug. 18, 2016

(30) Foreign Application Priority Data

Oct. 16, 2013 (SE) ..... 1351227

(51) Int. Cl.
*F01L 9/02* (2006.01)
*F02F 1/24* (2006.01)

(52) U.S. Cl.
CPC ..... *F01L 9/02* (2013.01); *F02F 1/24* (2013.01); *F02F 2001/245* (2013.01)

(58) Field of Classification Search
CPC ..... F01L 9/02; F02F 1/24; F02F 2001/245
(Continued)

(56) References Cited

U.S. PATENT DOCUMENTS 4,878,464 A * 11/1989 Richeson, Jr. ..... F01L 9/026 123/90.11

FOREIGN PATENT DOCUMENTS

| | | |
|---|---|---|
| DE | 1 159 690 B | 12/1963 |
| EP | 0 328 195 A2 | 8/1989 |
| GB | 2 102 065 A | 1/1983 |

OTHER PUBLICATIONS

Supplementary European Search Report issued in Application No. 14854199.8, dated May 8, 2017.

(Continued)

*Primary Examiner* — Ching Chang
(74) *Attorney, Agent, or Firm* — Young & Thompson

(57) ABSTRACT

A combustion engine includes, a cylinder head including a controllable first engine valve arranged to selectively open/close a combustion chamber included in the combustion engine, a first valve actuator operatively connected to the first engine valve, which first valve actuator includes at least one inlet opening for pressure fluid and at least one outlet opening for pressure fluid, and a closed pressure fluid circuit, wherein the first valve actuator is arranged in the closed pressure fluid circuit. The combustion engine further includes a cylinder head chamber that forms part of the closed pressure fluid circuit and that is delimited by the cylinder head and at least a first cylinder head mantle, wherein the at least one outlet opening of the first valve actuator is in fluid communication with the cylinder head chamber. A mantle assembly for a cylinder head of a combustion engine is also described.

16 Claims, 5 Drawing Sheets

(58) Field of Classification Search
USPC ..... 123/90.12, 90.13
See application file for complete search history.

(56) References Cited

OTHER PUBLICATIONS

International Search Report, dated Feb. 17, 2015, from corresponding PCT application.

* cited by examiner

COMBUSTION ENGINE AND MANTLE ASSEMBLY THEREFORE

TECHNICAL FIELD OF THE INVENTION

The present invention relates in general to a combustion engine suitable for powering a vehicle, such as a car or a truck, a boat etc. or a machine such as an electric power generation unit or the like. The combustion engines concerned are camshaft free piston engines, which are also known under the concept "engines with free valves". The present invention relates in particular to a combustion engine comprising a cylinder head comprising a controllable first engine valve arranged to selectively open/close a combustion chamber included in the combustion engine, a first valve actuator operatively connected to said first engine valve, which first valve actuator comprises at least one inlet opening for pressure fluid and at least one outlet opening for pressure fluid, and a closed pressure fluid circuit, wherein said first valve actuator is arranged in said closed pressure fluid circuit.

In a second aspect, the present invention relates to a mantle assembly intended to be connected to a combustion engine.

BACKGROUND OF THE INVENTION AND STATE OF THE ART

In a camshaft free combustion engine a pressure fluid, such as a liquid or a gas, is used to achieve a displacement/opening of one or more engine valves. This means that the camshafts, and related equipment, that conventional combustion engines use to open engine valves to let air in respective let exhaust fumes out from the combustion chamber, has been replaced by a less volume demanding and more controllable system.

In an engine that is constructed for significant angular momentum outputs, the pressure in the combustion chamber is increasing proportional to an increased angular momentum output, and the force that is required to open the valve actuator to open the, in relation to the combustion chamber inward opening, engine valve is consequently also increases proportional to an increased angular momentum output. At high numbers of revolutions, such as 6-8000 rpm, a very fast opening of the engine valve is also required for the filling of air respective evacuation of exhaust fumes from the engine cylinder not to be restricted. These requirements, i.e. the need for an extremely fast opening at high frequencies in a high performance engine having high counter pressure in the combustion chamber of the engine at the opening of the exhaust valves, require the pressure of the pressure fluid upstream of the valve actuator to be high, in the order of 8-30 bar.

Downstream of the valve actuator, the pressure fluid has a lower pressure, in the order of 3-6 bar, and when the pressure of the pressure fluid shall be increased by way of a compressor from the low pressure downstream of the valve actuator to the high pressure upstream of the valve actuator, a temperature rise occurs that increases concurrently with an increased pressure condition.

It is desirable that the pressure of the pressure fluid that is led to the compressor is relatively low, and thereby more compact, for achieving a high efficiency of the compressor. Heat is added to the pressure fluid during the compression. If the pressure ratio between the high pressure side and the low pressure side is too high, it leads to a temperature of the pressure that is too high on the high pressure side, which increases the risk of oxidation of the oil that is used concurrently with increasing temperature of the pressure fluid. This means that a part of the increased temperature at the low pressure side has to be lowered by cooling, which leads to energy losses and a need for cooling equipment.

The pressure fluid circuit of the combustion engine is a closed circuit in which pressure fluid is conventionally led via conduits from a compressor to pressure fluid inlets of the valve actuators, and then led via conduits from the pressure fluid outlets of the valve actuators back to the compressor. During operation of the combustion engine, the need for pressure difference between the low pressure side and the high pressure side varies.

As a result of the pressure fluid circulating in a closed system, the compressor will at high pressure differences take air from the low pressure side and bring it over to the high pressure side. Hereby the pressure difference will increase, which is desirable. Unfortunately, the pressure ratio between high pressure side and the low pressure side will unfortunately increase, both due to the fact that the high pressure level rises and to the fact that the low pressure simultaneously falls. An increasing pressure ratio leads to the temperature of the pressure fluid increases downstream of the compressor.

Individual conduits from the outlets of the valve actuators additionally lead to pressure fluid limitations and increased complexity in manufacturing and assembling.

BRIEF DESCRIPTION OF THE OBJECT OF THE INVENTION

The aim of the present invention is to set aside the abovementioned drawbacks and shortcomings of the previously known combustion engines and to provide an improved combustion engine. A fundamental object of the invention is to provide an improved combustion engine of the initially defined type, in which pressure fluid limitations are reduced simultaneously to the pressure ratio between the high pressure side and the low pressure side may be limited in spite of varying and sufficient pressure difference between the high pressure side and the low pressure side.

Another object of the present invention is to provide a mantle assembly that can be used to convert conventional camshaft controlled combustion engines to include valve actuators.

BRIEF DESCRIPTION OF THE INVENTION

According to the invention, the main object is at least achieved by way of the initially defined combustion engine having the features defined in the independent claim 1. Preferred embodiments of the present invention are further defined in the subsequent dependent claims.

According to a first aspect of the present invention, a combustion engine of the initially defined type is provided that is characterized by comprising a cylinder head chamber that forms part of said closed pressure fluid circuit and that is delimited by said cylinder head and at least a first cylinder head mantle, wherein said at least one outlet opening of the first valve actuator is in fluid communication with said cylinder head chamber.

According to a second aspect of the present invention, a mantle assembly for a cylinder head of a combustion engine is provided that is characterized by the mantle assembly comprises a first cylinder head mantle arranged to partly delimit a cylinder head chamber, and a first valve actuator releasably connected to said first cylinder head mantle, wherein said first valve actuator comprises at least one outlet opening for pressure fluid, and wherein the at least one outlet opening of the first valve actuator is arranged to be in fluid communication with said cylinder head chamber. The mantle assembly constitutes a typical delivery part of a sub-contractor to an engine manufacturer.

The two abovementioned aspects of the present invention are accordingly based on the common inventive idea that by using on the low pressure side of the closed pressure fluid circuit a cylinder head chamber, that is a collecting tank for a large pressure fluid volume, instead of individual conduits, the pressure fluid limitations will then be reduced and the pressure ratio over the valve actuator will be restricted simultaneous to a varying and sufficient pressure difference over the valve actuator is allowed, which reduces the temperature rise of the pressure fluid upstream of the valve actuator.

According to a preferred embodiment of the present invention, the first cylinder head mantle comprises a pressure fluid manifold that is connected to the at least one inlet opening of the first valve actuator. This way, a compact and simple connection for pressure fluid to the high pressure side of the valve actuator is achieved.

Preferably, the first cylinder head mantle comprises a hydraulic fluid manifold that is connected to a hydraulic circuit of the first valve actuator. This way, a compact and simple connection for hydraulic liquid to the valve actuator is achieved.

According to a preferred embodiment, the combustion engine comprises a second valve actuator operatively connected to a controllable second engine valve included in the cylinder head and arranged to selectively open/close said at least one combustion chamber, which second valve actuator comprises at least one inlet opening for pressure fluid and at least one outlet opening for pressure fluid, wherein said second valve actuator is arranged in said closed pressure fluid circuit, and wherein said at least one outlet opening of the second valve actuator is in fluid communication with said cylinder head chamber. The cylinder head chamber is further delimited by a second cylinder head mantle, wherein said second valve actuator is releasably connected to said second cylinder head mantle. By the cylinder head mantle being divided in two parts, where each part is connected to different valve actuators, a simple assembling of several valve actuators in the engine is allowed, even though the valve actuators have relative angular orientations to fit the inlet valves respective exhaust valves of the engine cylinders.

Further advantages with and features of the invention are evident from the remaining dependent claims and from the following detailed description of preferred embodiments.

BRIEF DESCRIPTION OF THE DRAWINGS

A more thorough understanding of the abovementioned and other features and advantages of the present invention will be evident from the following detailed description of preferred embodiments with reference to the enclosed drawings, on which.

DETAILED DESCRIPTION OF PREFERRED EMBODIMENTS

Figure 1:
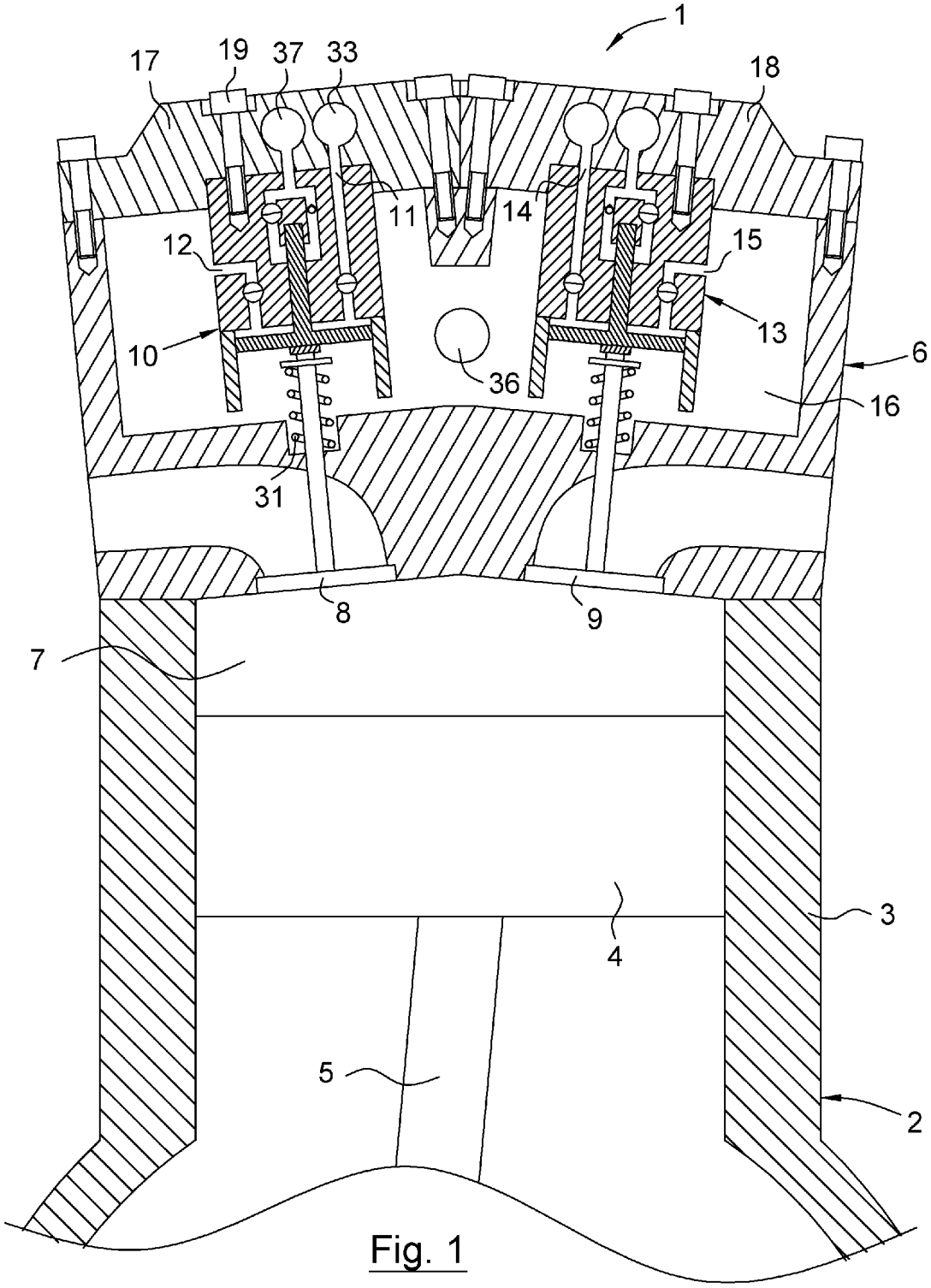
FIG. 1 is a schematic cross-sectional side view of a part of a combustion engine.

Reference is initially made to FIG. 1 that is a schematic depiction of a part of an inventive combustion engine, generally designated 1. The combustion engine 1 comprises a cylinder block 2 with at least one cylinder 3. Said cylinder block 2 generally comprises three or four cylinders 3. In the shown embodiment one cylinder 3 is described, it should nevertheless be realized that he equipment described below in relation to the shown cylinder 3 is preferably applied to all of the cylinders of the combustion engine 1, in the embodiment the combustion engine comprises more cylinders.

Furthermore, the combustion engine 1 comprises a piston 4 that is axially displaceable in said cylinder 3. The movement, axial displacement forth and back, of the piston 4 is transferred on a conventional manner to a connection rod 5 connected with the piston 4, the connection rod 5 in turn is connected with and drives a crank shaft (not shown) in rotation.

The combustion engine 1 also comprises a cylinder head 6 that together with said cylinder 3 and said piston 4 delimits a combustion chamber 7. In the combustion chamber 7 the ignition of a mix of fuel and air occurs in a conventional manner and is not further described herein. The cylinder head 6 comprises a controllable first engine valve 8, also known as a gas exchange valve. In the shown embodiment, the cylinder head also comprises a controllable second engine valve 9. Said first engine valve 8 constitutes, in the shown embodiment, an inlet valve that is arranged to selectively open/close for supply of air to the combustion chamber 7. The second engine valve 9 constitutes in the shown embodiment an air outlet valve, or exhaust valve, that is arranged to selectively open/close for evacuation of exhausts form the combustion chamber 7.

The combustion engine 1 further comprises a first valve actuator 10 that is operatively connected to said first engine valve 8 and that is arranged in a closed pressure fluid circuit of the combustion engine 1. The first valve actuator 10 comprises at least one inlet opening 11 for pressure fluid and at least one outlet opening 12 for pressure fluid. The pressure fluid is a gas or a gas mixture, preferably air or nitrogen gas. Air has the advantage that it is easy to change the pressure fluid or to supply more pressure fluid if the closed pressure fluid circuit leaks, and nitrogen gas has the advantage that it lacks oxygen, which prevents oxidation of other elements. In the shown embodiment the combustion engine 1 also comprises a second valve actuator 13 that is operatively connected to said second engine valve 9 and that is arranged in said closed pressure fluid circuit parallel with said first valve actuator 10. The second valve actuator 13 comprises at least one inlet opening 14 for pressure fluid and at least one outlet opening 15 for pressure fluid.

Each valve actuator can be operatively connected with one or more engine valves, for example the combustion engine may comprise two inlet valves which are jointly driven by the same valve actuator, however it is preferred that each valve actuator drives one engine valve each to achieve the greatest possible control of the operation of the combustion engine 1.

In the description below, only the first valve actuator 10 will be described, but it should be realized that if nothing else is said, the corresponding is also true for the other valve actuator 13.

The combustion engine 1 also comprises a cylinder head chamber 16 that forms part in said closed pressure fluid circuit and that is delimited by said cylinder head 6 and at least a first cylinder head mantle 17. In the shown embodiment, a second cylinder head mantle 18 is also found that contributes to delimiting the cylinder head chamber 16. The cylinder head chamber 16 preferably presents a volume of the order of 3-10 liter, typically on the order of 5-6 liter. In an alternative embodiment, only said first cylinder head mantle 17 is present that, together with the cylinder head 6, alone delimit the cylinder head chamber 16.

Essential to the present invention is that the at least one outlet opening 12 of the first valve actuator 10 is in fluid communication with the cylinder head chamber 16, i.e. that the pressure fluid leaving the first valve actuator 10 via said at least one outlet opening 12 flows out in the cylinder head chamber 16.

In the shown embodiment the at least one outlet opening 15 of the second valve actuator 13 is in fluid communication with said cylinder head chamber 16, i.e. the outlet openings for pressure fluid of all the valve actuators preferably lead to the same cylinder head chamber.

Preferably, the whole of the first valve actuator 10 is arranged in said cylinder head chamber 16, and it is also preferred that the first valve actuator 10 is releasably connected to said first cylinder head mantle 17, for example by a bolt 19, or similar holding means. In this embodiment, the first valve actuator 10 accordingly "hangs" in the first cylinder head mantle 17 without being in contact with the cylinder head 6. If the first valve actuator 10 should be in contact with both the first cylinder head mantle 17 and the cylinder head 6, a construction wise disadvantageous tolerance chain is achieved.

Reference is now primarily made to the FIGS. 2-7, which show the first valve actuator 10 in different states of operation.

The first valve actuator 10 comprises an actuator piston disc 20 and an actuator cylinder 21 delimiting a downward open cylinder volume. The actuator piston disc 20 divides said cylinder volume in a first upper part 22 and a second lower part 23 and is axially displaceable in said actuator cylinder 21. The actuator piston disc 20 forms part of an actuator piston, generally denoted 24, that is arranged to contact and drive said first engine valve 8. The actuator piston further comprises means 25 for play elimination in axial direction in relation to said first engine valve 8. The play eliminating means 25 are preferably hydraulic, and assures that when the actuator piston disc 24 is in its upper turn position, the actuator piston 24 remains in contact with the first engine valve 8 when it is closed, for the purpose of correcting for assembly tolerances, heat expansion, etc. Accordingly, the axial length of the actuator piston 24 is adjusted by way of the play eliminating means 25.

The other part 23 of the cylinder volume of the first valve actuator 10 is in fluid communication with said cylinder head chamber 16. This way, it is guaranteed that the same pressure acts on the actuator piston disc 20 from the first part 22 of the cylinder volume respective from the second part 23 of the cylinder volume when the actuator piston 24 is in the upper turn position. By that, the sealing between the actuator piston disc 20 and the actuator cylinder 12 is not critical, and some leakage can be allowed for minimizing the resistance to displacement of the actuator piston disc 20, and in resting position, the actuator piston disc is not affected by changes in the low pressure level.

The first valve actuator 10 comprises a controllable inlet valve 26 that is arranged to open/close the inlet opening 12, a controllable outlet valve 27 that is arranged to open/close the outlet opening 11, a hydraulic circuit, generally designated 28, that in turn comprises a non-return valve 29 arranged to allow filling of the hydraulic circuit 28, and a controllable emptying valve 30 arranged to control the emptying of the hydraulic circuit 28. It should be pointed out that the valves in the valve actuator 10 are schematically depicted and can for example be constituted by sliding valves, seat valves, etc. Furthermore, several of the above-mentioned controllable valves may be constituted by a single body. Each valve can further be directly or indirectly electrically controlled. With directly electrically controlled is meant that the position of the valve is directly controlled by, for example, an electro-magnetic device, and with indirect electrically controlled is meant that the position of the valve is controlled by a pressure fluid that in turn is controlled by, for example, an electro-magnetic device.

Figure 2:
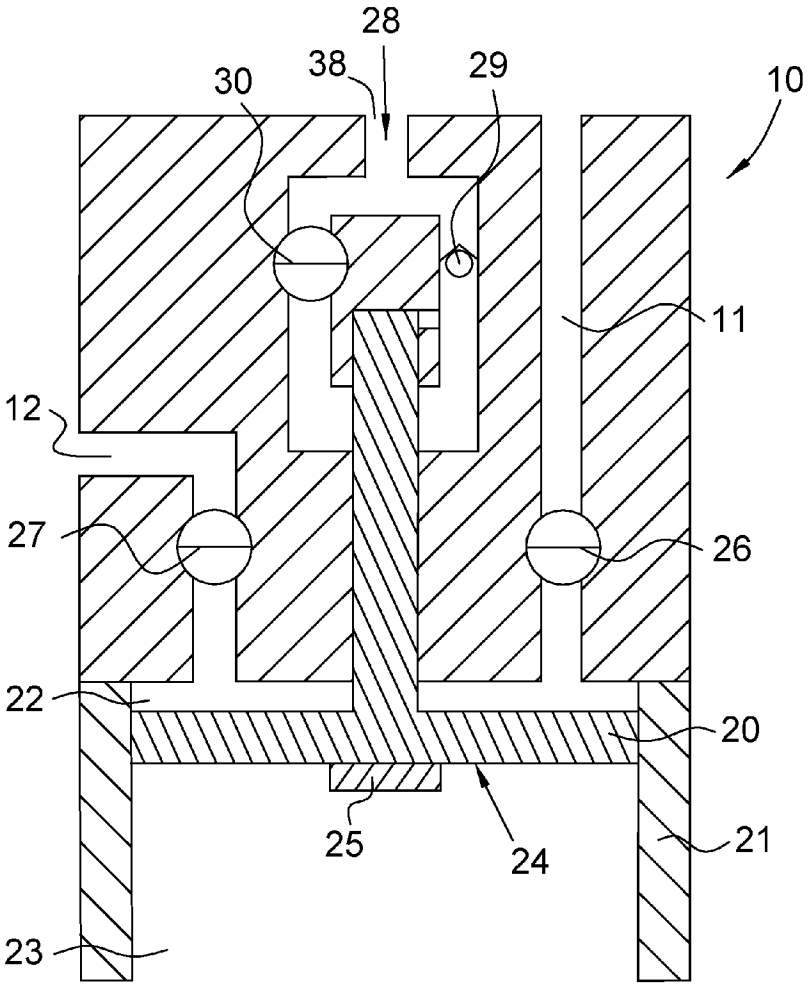

In FIG. 2, the first valve actuator 10 is in an inactive state and ready for being set in an active state. The inlet valve 26, the outlet valve 27, and the emptying valve 30 of the hydraulic circuit 28 are closed. The actuator piston disc 20 is accordingly in an upper position, and the actuator piston 24 is ready to open the engine valve (not shown in FIGS. 2-7, see FIG. 1)

Figure 3:
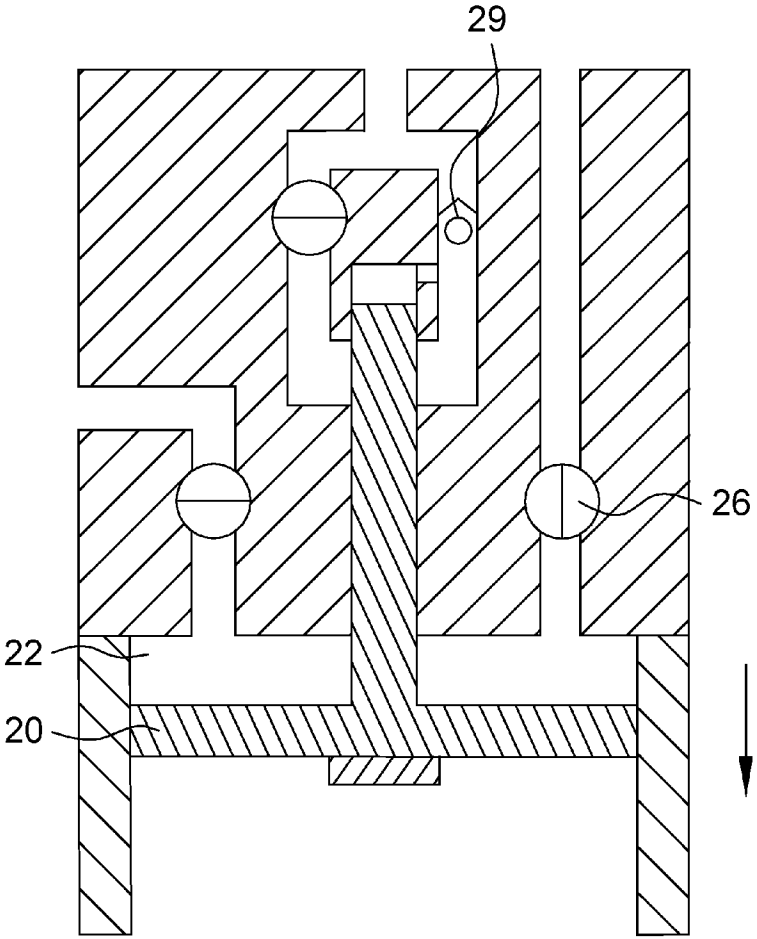
FIG. 2-7 show a schematic cross-sectional side view of a valve actuator in different states.

In FIG. 3, the inlet valve 26 has been opened to allow filling of pressure fluid with a high pressure in the upper part 22 of the cylinder volume, after which the actuator piston disc 10 starts a downward movement, i.e. is displaced downward. The non-return valve 29 of the hydraulic circuit 28 allows for the hydraulic fluid to be sucked in and replace the volume that the actuator piston 24 leaves.

Figure 4:
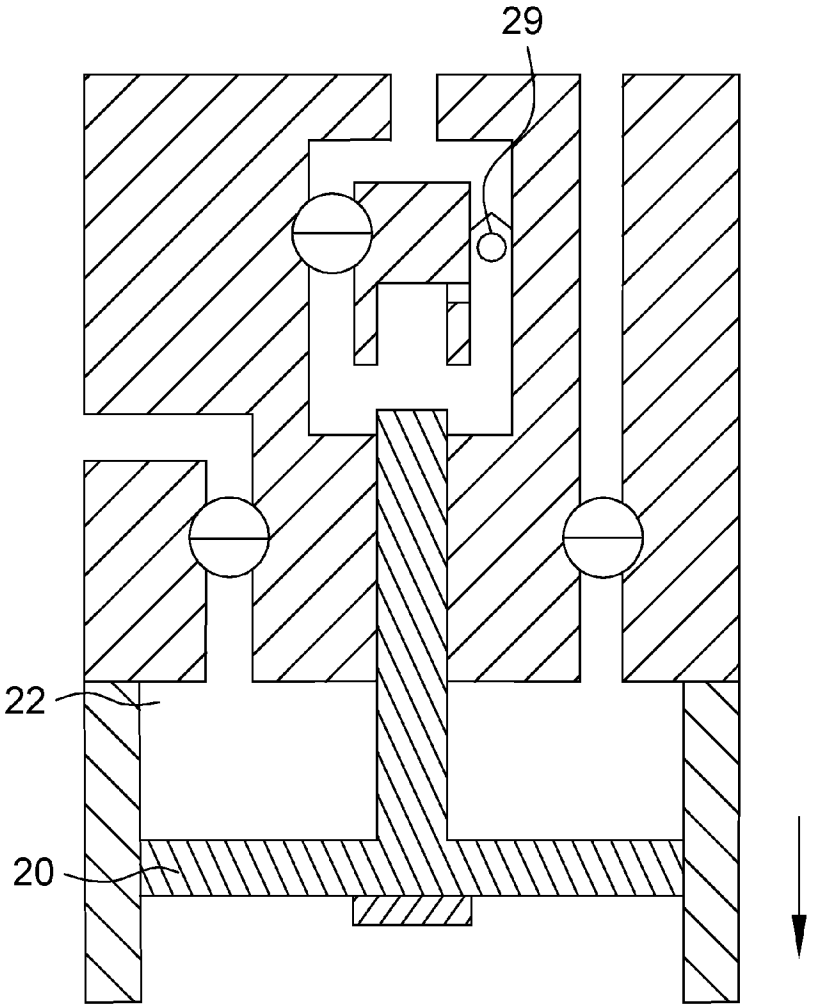

In FIG. 4, the inlet valve 26 has been closed and the pressure fluid that has entered the upper part 22 of the cylinder volume is allowed to expand, after which the actuator piston disc 20 continues its movement downward. The non-return valve 29 of the hydraulic circuit 28 is still open.

Figure 5:
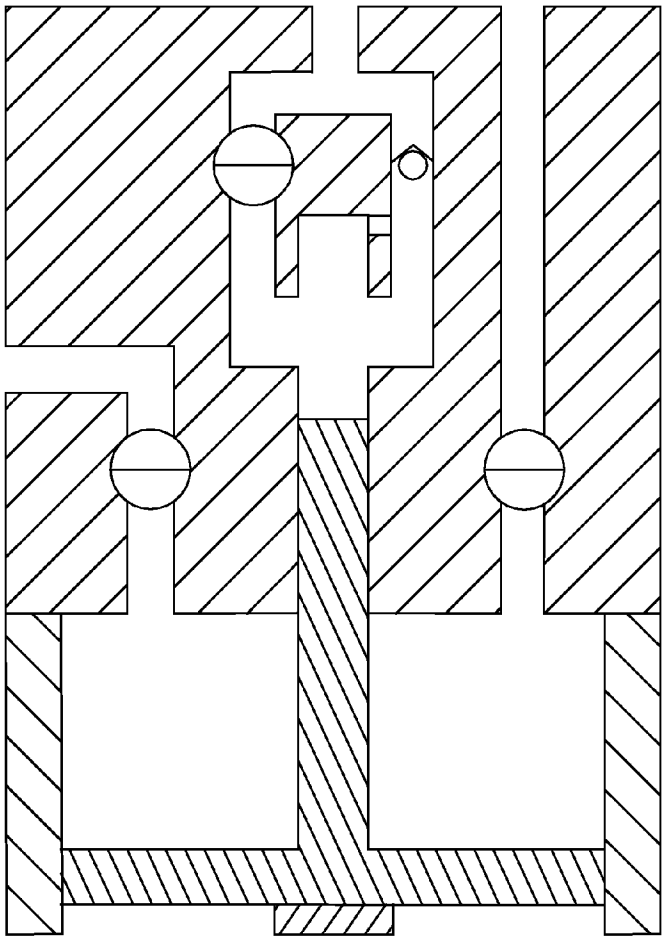

In FIG. 5, the pressure fluid in the upper part 22 of the cylinder volume is not capable of displacing the actuator piston disc 20 further. The pressure on the lower side of the actuator piston disc 20 and the return spring 31 of the first engine valve 8 is as high as the pressure on the upper side of the actuator piston disc 20. The actuator piston disc 30 is kept in place (is locked) in its lower position a desired amount of time by the emptying valve 30 of the hydraulic circuit 28 being kept closed at the same time as the non-return valve 28 of the hydraulic circuit 28 is closed automatically.

Figure 6:
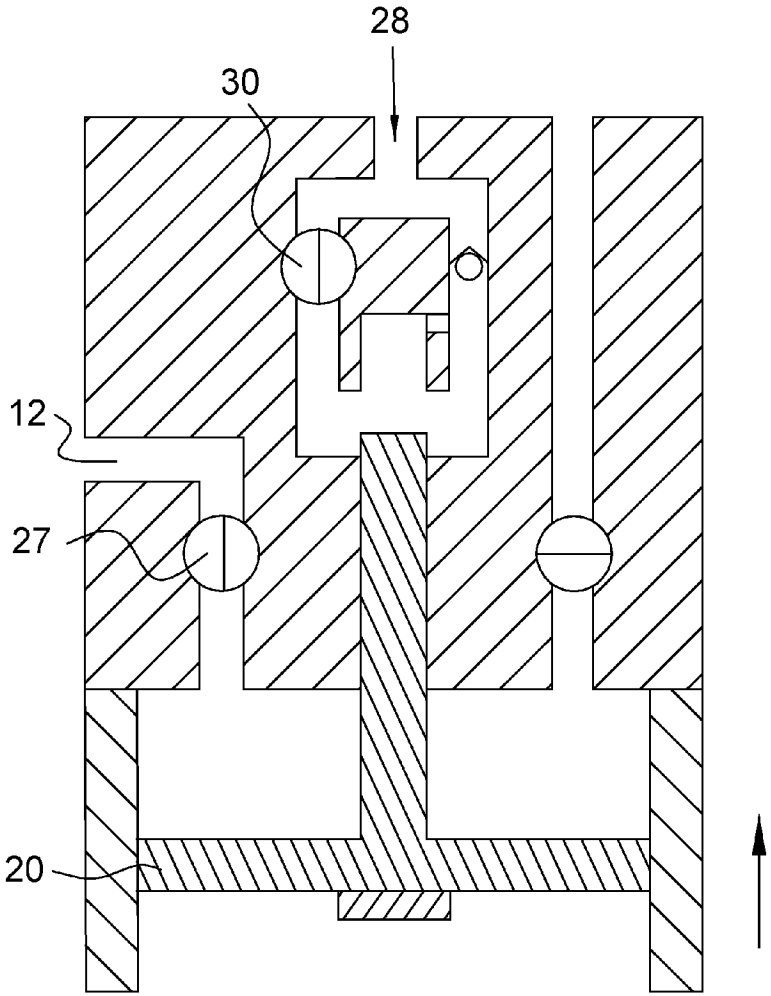

In FIG. 6, the outlet valve 27 has been opened to admit an evacuation of pressure fluid from the upper part 22 of the cylinder volume, and additionally the emptying valve 30 of the hydraulic circuit 28 has been opened, after which the actuator piston disc 20 is displaced upwards when the hydraulic fluid is evacuated from the hydraulic circuit 28, and at the same time pressure fluid is evacuated from the upper part 22 of the cylinder volume to the cylinder head chamber 16.

Figure 7:
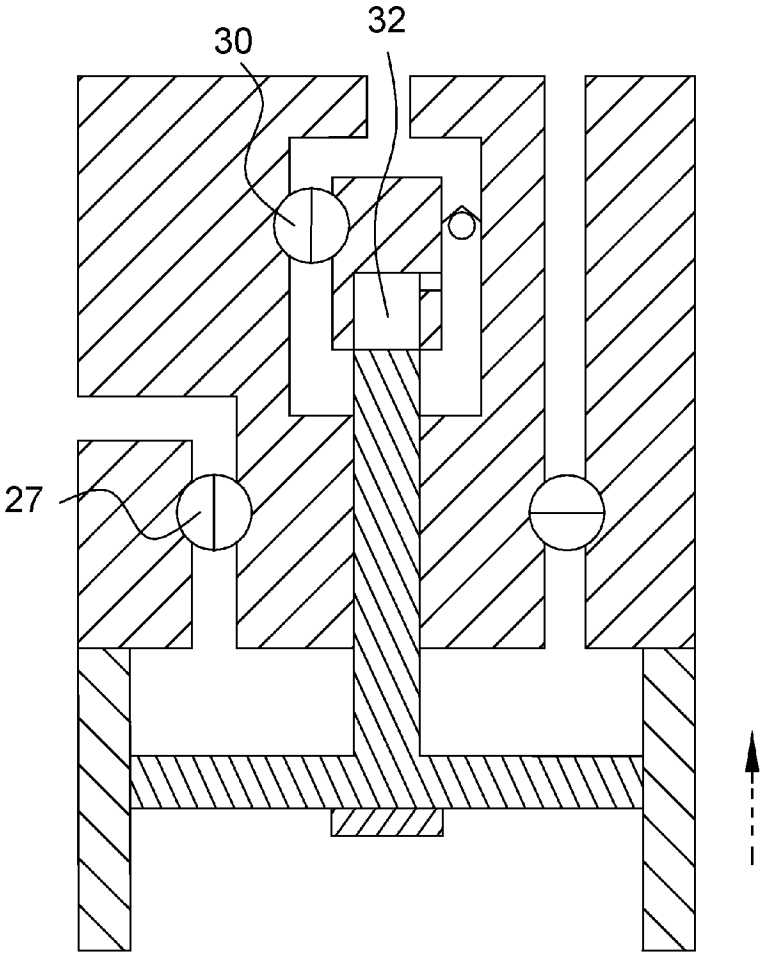

In FIG. 7, the outlet valve 27 and the emptying valve 30 of the hydraulic circuit 28 are still open, and the return movement of the actuator piston 24 is slowed down by way of a hydraulic break means 32 incorporated in the hydraulic circuit 28.

The hydraulic fluid is preferably oil, and most preferably of the same type as the normal engine oil of the combustion engine 1.

Figure 8:
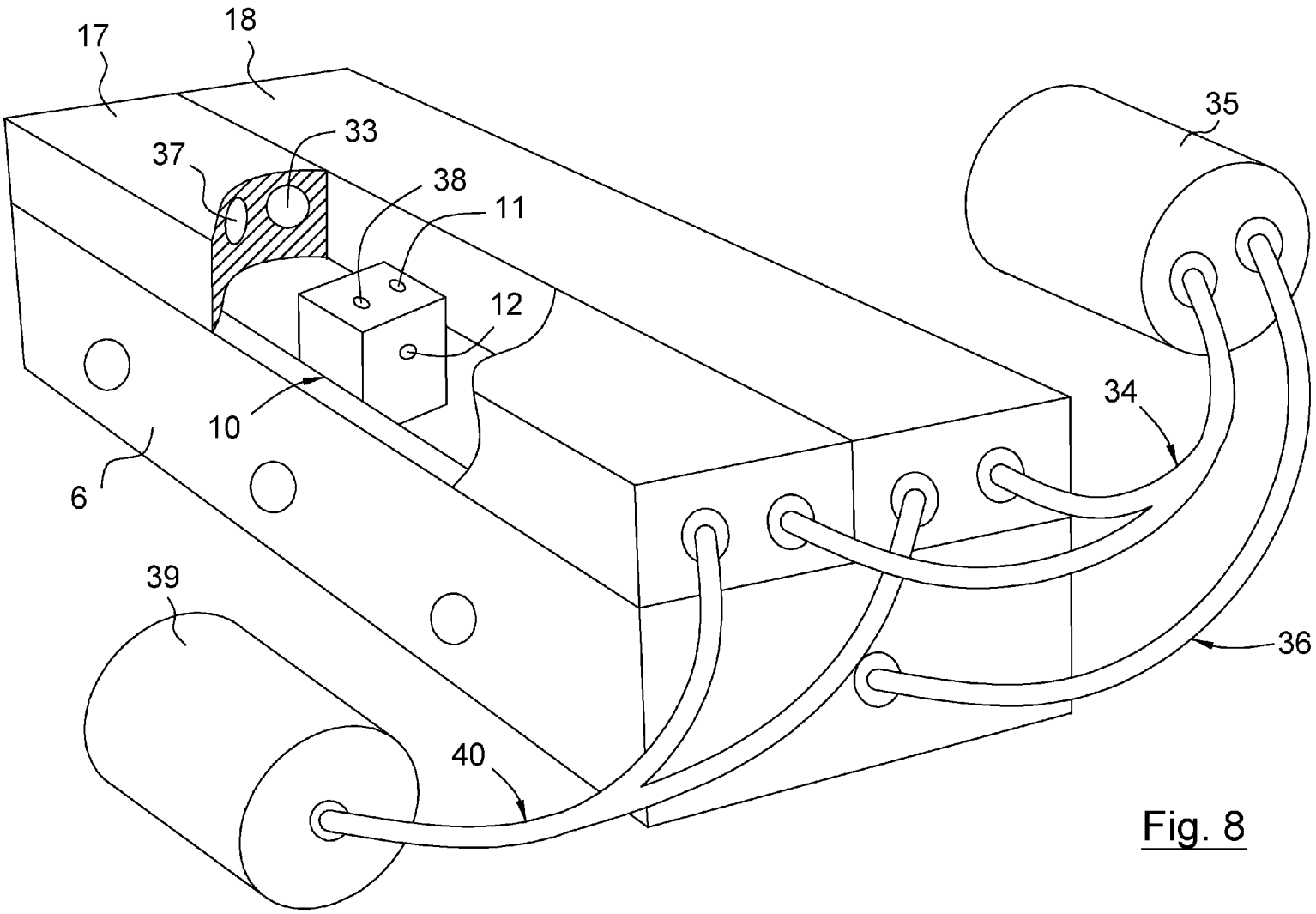
FIG. 8 is a partly cross-sectional schematic perspective view of a cylinder head and cylinder head mantles.

Reference is now made to FIG. 8, which schematically shows the cylinder head 6, the first cylinder head mantle 17 and the second cylinder head mantle 18.

The first cylinder head mantle 17 comprises a pressure fluid manifold 33 that is connected to the at least one inlet opening 11 of the first valve actuator 10. The pressure fluid manifold 33 extends along the axial length of the first cylinder head mantle 17. Said pressure fluid manifold 33 forms part of a primary pressure fluid channel 34 that extends from a compressor 35 to the at least one inlet opening 11 of the first valve actuator 10. The compressor 35 is arranged to supply a pressure fluid under high pressure to the valve actuators. Furthermore, a secondary pressure fluid channel 36 (see also FIG. 1) extends from the cylinder head chamber 16 to said compressor 35.

The volume of the primary pressure fluid channel 34, high pressure side, shall be kept as small as possible so that the temperature of the pressure fluid will sink as little as possible from the compressor 35 to the first valve actuator 10. The volume of the cylinder head chamber 16 and the secondary pressure fluid channel 36, low pressure side, shall on the other hand be maximized so that the pressure ratio between the low pressure side and the high pressure side is affected as little as possible when the compressor 35 pulls gas/pressure fluid from the low pressure side. Preferably, the volume of the cylinder head chamber 16 and the secondary pressure fluid channel 36 is at least ten times greater than the volume of the primary pressure fluid channel 34, most preferably at least 15 times greater.

The compressor 35 has variable compressor volume/displacement, or by other means adjustable outflow, and generally the compressor 35 is driven by the crank shaft of the combustion engine 1. At high numbers of revolutions and high torque output, higher pressure of the pressure fluid in the primary pressure fluid channel 34 is required, and at low numbers of revolutions and low torque output, lower pressure of the pressure fluid in the primary pressure fluid channel 34 is required.

The pressure level on the high pressure side in in the order of 8-30 bar to, with sufficient speed, open an inward opening engine valve where a high counter pressure is present in the combustion chamber, and the pressure level on the low pressure side is in the order of 4-8 bar to hold the pressure ratio below 1:4, preferably below 1:3. The aim is to hold the temperature of the pressure fluid in the primary pressure fluid channel 34 below 120° C. under normal operation for avoiding oxidizing a hydraulic fluid mist that is present in the pressure fluid, however temperatures up to 150° C. can be allowed for short periods.

The first cylinder head mantle 17 further comprises a hydraulic liquid manifold 37 that is connected with an inlet opening 38 of said hydraulic circuit 28 of the first valve actuator 10. The hydraulic liquid manifold 37 extends along the axial length of the first cylinder head 17, parallel to the pressure fluid manifold 33. A pump 39, or the like, is arranged to supply a pressurized hydraulic liquid to the hydraulic liquid manifold 37 via a conduit 40.

The first cylinder head mantle 17 further comprises all necessary electric infrastructure (not shown) for, among other things, controlling the first valve actuator 10, for various sensors, etc.

In conventional combustion engines 1, the first engine valve 8 (air supply valve) and the second engine valve 9 (exhaust valve) are arranged at an angle in relation to one another, i.e. their respective valve shafts point in different directions in relation to the engine cylinders 3, and the first valve actuator 10 must be arranged in line with the first shaft of the first engine valve 8 to achieve optimum operation. As a result of the relative separating orientation and of the valve actuators being connected with respective cylinder head mantle before these are mounted on the cylinder head 6, it is preferable that the first cylinder head mantle 17 is applied on the cylinder head 6 in line with the shaft of the first engine valve 8 and that the second cylinder head mantle 18 is applied on the cylinder head 6 in line with the shaft of the second engine valve 9.

Conceivable Modifications of the Invention

The invention is not limited to only the abovementioned and embodiments shown in the drawings, which only have an illustrating and exemplifying purpose. This patent application is intended to cover all modifications and variants of the preferred embodiments described herein, and the present invention is consequently defined by the wording of the enclosed claims and the equipment can thus be modified in all conceivable ways within the framework of the enclosed claims.

It should also be pointed out that all information about/concerning terms such as above, below, upper, lower, etc. shall be interpreted/read with the equipment oriented in accordance with the figures, with the drawings oriented in such a way that the reference numbers can be read in a correct manner. Consequently, such terms indicates only relative relationships in the shown embodiments, which relationships can be changed if the equipment according to the invention is provided with another construction/design.

It should be pointed out that even if it is not explicitly stated that features from a specific embodiment can be combined with the features of another embodiment, this should be regarded as obvious when so is possible.

The invention claimed is:

1. A combustion engine, comprising:

a cylinder head (6) that comprises a controllable first engine valve (8) arranged to selectively open/close a combustion chamber (7) included in the combustion engine (1), and a controllable second engine valve (9) arranged to selectively open/close the combustion chamber (7);

a first valve actuator (10) operatively connected to said first engine valve (8), said first valve actuator (10) comprising at least one inlet opening (11) for pressure fluid and at least one outlet opening (12) for pressure fluid;

a second valve actuator (13) operatively connected to said second engine valve (9), said second valve actuator (13) comprising at least one inlet opening (14) for pressure fluid and at least one outlet opening (15) for pressure fluid;

a closed pressure fluid circuit, said first valve actuator (10) and said second valve actuator (13) being arranged in parallel with each other in said closed pressure fluid circuit; and a cylinder head chamber (16) that forms part of said closed pressure fluid circuit, said cylinder head chamber (16) delimited by said cylinder head (6) and at least a first cylinder head mantle (17), wherein both said at least one outlet opening (12) of the first valve actuator (10) and said at least one outlet opening (15) of the second valve actuator (13) are in fluid communication with said cylinder head chamber (16).

2. The combustion engine according to claim 1, wherein said first valve actuator (10) is arranged in said cylinder head chamber.

3. The combustion engine according to claim 2, wherein said first valve actuator (10) is releasably connected to said first cylinder head mantle (17).

4. The combustion engine according to claim 2, wherein said first valve actuator (10) delimits a cylinder volume, and comprises an actuator piston disc (20) that divides a first part (22) of the cylinder volume from a second part (23) of the cylinder volume, said actuator piston disc (20) being axially displaceable in said cylinder volume.

5. The combustion engine according to claim 1, wherein said first valve actuator (10) is releasably connected to said first cylinder head mantle (17).

6. The combustion engine according to claim 5, wherein said first valve actuator (10) delimits a cylinder volume, and comprises an actuator piston disc (20) that divides a first part (22) of the cylinder volume from a second part (23) of the cylinder volume, said actuator piston disc (20) being axially displaceable in said cylinder volume.

7. The combustion engine according to claim 1, wherein said first valve actuator (10) delimits a cylinder volume, and comprises an actuator piston disc (20) that divides a first part (22) of the cylinder volume from a second part (23) of the cylinder volume, said actuator piston disc (20) being axially displaceable in said cylinder volume.

8. The combustion engine according to claim 7, wherein the actuator piston disc (20) forms part of an actuator piston (24) arranged to contact said first engine valve (8), and wherein the actuator piston (24) further comprises means (25) for eliminating play in axial direction in relation to said first engine valve (8).

9. The combustion engine according to claim 8, wherein the second part (23) of the cylinder volume of the first valve actuator (10) is in fluid communication with said cylinder head chamber (16).

10. The combustion engine according to claim 7, wherein the second part (23) of the cylinder volume of the first valve actuator (10) is in fluid communication with said cylinder head chamber (16).

11. The combustion engine according to claim 1, wherein said first cylinder head mantle (17) comprises a pressure fluid manifold (33) that is connected to the at least one inlet opening (11) of the first valve actuator (10).

12. The combustion engine according to claim 11, wherein said pressure fluid manifold (33) forms part of a primary pressure fluid channel (34) extending from a compressor (35) to the at least one inlet opening (11) of the first valve actuator (10).

13. The combustion engine according to claim 12, wherein a secondary pressure fluid channel (36) extends from the cylinder head chamber (16) to said compressor (35).

14. The combustion engine according to claim 1, wherein the cylinder head chamber (16) is further delimited by a second cylinder head mantle (18).

15. The combustion engine according to claim 14, wherein said second valve actuator (13) is releasably connected to said second cylinder head mantle (18).

16. A mantle assembly for a cylinder head (6) of a combustion engine (1), comprising:

a first cylinder head mantle (17) and a second cylinder head mantle (18), each arranged to partly delimit a cylinder head chamber of the cylinder head (6);

a first valve actuator (10) releasably connected to said first cylinder head mantle (17); and a second valve actuator (13) releasably connected to said second cylinder head mantle (18);

wherein said first valve actuator (10) comprises at least one outlet opening (12) for pressure fluid, wherein said second valve actuator (13) comprises at least one outlet opening (15) for pressure fluid, and wherein both the at least one outlet opening (12) of the first valve actuator (10) and the at least one outlet opening (15) of the second valve actuator (13) are arranged to be in fluid communication with said cylinder head chamber of the cylinder head (6).

* * * * *